US006476544B1

(12) United States Patent
Ishii et al.

(10) Patent No.: US 6,476,544 B1
(45) Date of Patent: Nov. 5, 2002

(54) COLOR CATHODE RAY TUBE

(75) Inventors: Sakae Ishii, Mobara (JP); Yasuhisa Shiraishi, Mobara (JP); Satoru Miyamoto, Mobara (JP)

(73) Assignees: Hitachi, Ltd., Tokyo (JP); Hitachi Electronic Devices Co., Ltd., Mobara (JP)

( * ) Notice: Subject to any disclaimer, the term of this patent is extended or adjusted under 35 U.S.C. 154(b) by 0 days.

(21) Appl. No.: 09/521,966

(22) Filed: Mar. 9, 2000

(51) Int. Cl.[7] ..... H01J 29/50
(52) U.S. Cl. ..... 313/417; 313/414; 313/412
(58) Field of Search ..... 313/417, 414, 313/412, 409, 413, 415, 448

(56) References Cited

U.S. PATENT DOCUMENTS 6,184,614 B1 * 2/2001 Uchida et al. ..... 313/414
6,273,776 B1 * 8/2001 Cha et al. ..... 445/36
6,281,624 B1 * 8/2001 Koshigoe et al. ..... 313/451

* cited by examiner

*Primary Examiner*—Vip Patel
*Assistant Examiner*—Kenneth Berck
(74) *Attorney, Agent, or Firm*—Antonelli, Terry, Stout & Kraus, LLP

(57) ABSTRACT

A color cathode ray tube includes an electron gun having cathode structures arrayed in line with a cup-shaped first grid electrode. Each of the cathode structures is fused and fixed to a cathode in an electrically insulated state by hermetic glass. A cathode support to which the cathode structures are fixed by glass is fixedly housed in the cup-shaped first grid electrode, and the first grid electrode and the cathode support are welded on an axis along which the cathode structures are arrayed. The cathode structures and the first grid electrode are welded on an inline axis so that the thermal deformation of the cathode support can be made uniform at the center portion and at side portions. Accordingly, at the start-up time of the color cathode ray tube, the cathode currents at the center portion and at the side portions can be equalized and a good color balance can be maintained on the screen.

5 Claims, 6 Drawing Sheets

COLOR CATHODE RAY TUBE

BACKGROUND OF THE INVENTION

The present invention relates to a color cathode ray tube and, more particularly, to a color cathode ray tube having an electron gun in which a cathode structure arrayed in line within a cup-shaped first grid electrode is fixedly housed.

Color cathode ray tubes having a plurality of cathodes arrayed in line are generally used as image display devices for television receivers or monitors of data processing terminals.

This kind of cathode ray tube (CRT) has an evacuated envelope comprising a panel portion having a phosphor screen formed on its inner surface, a neck portion which houses an electron gun structure, and a funnel portion which connects the panel portion and the neck portion. A widely used type of electron gun structure is an inline type electron gun structure constructed to emit three electron beams toward the phosphor screen in a horizontal plane.

FIG. 7 is a view illustrating an example of a typical electrode gun for use in a cathode ray tube, which electron gun has a construction in which a cathode support and a first grid electrode are fixed. In FIG. 7, the electron gun has a cathode support 15 provided with a cathode inside, a cup-shaped first grid electrode 16, welding spots 17 at which the first grid electrode 16 and the cathode support 15 are welded to each other, electron beam passing holes 18 provided in the first grid electrode 16 (reference numerals denote 18S side electron beam passing holes, reference numeral 18C denotes a center electron beam passing hole), and a bead portion 19 to be buried into a bead glass to fix the first grid electrode 16.

The cathode support 15 is inserted inside of the cup-shaped first grid electrode 16 and is welded at the welding spots 17 in its open end portion. The welding spots 17 are also present in a back portion which is not shown in FIG. 7, so that first grid electrode 16 and the cathode support 15 are fixed to each other at four spots.

FIG. 8 is a cross-sectional view, taken in an inline direction, of a triode portion of the electron gun. Symbols K denote cathodes, and reference numerals 20 denote cathode structures each provided with a cathode K for emitting an electron beam toward the first grid electrode 16 (reference numeral 20S denotes side cathode structures, reference numeral 20C denotes a center cathode structure). The structure includes sleeves 21 to which the respective cathode structures are fixed, and a hermetic glass (insulating substrate) 22. The first grid electrode 16 is a cup-shaped electrode in which the cathode support 15 is housed. Each of the cathode structures 20 is fixed in an electrically insulated state by the hermetic glass 22, and is fixed to the cathode support 15.

During the start-up period of the cathode ray tube, each of the cathode structures 20 is heated by a heater which is not shown. Each of the cathode structures 20 is thermally expanded by this heating and the distance between the cathodes K and the electron beam passing holes of the first grid electrode 16 becomes smaller, so that a larger amount of cathode current flows. Then, the first grid electrode 16 is thermally expanded and the distance between the cathodes K and the electron beam passing holes of the first grid electrode 16 becomes longer, so that the cathode current becomes gradually less. After that, the thermal expansion of the cathode structures 20 and that of the first grid electrode 16 comes to an end and the distance between the cathodes K and the first grid electrode 16 stabilizes at a constant value, so that the brightness on the screen becomes constant.

The first grid electrode 16 and the cathode support 15 used in the illustrated electron gun differ from each other in coefficient of linear thermal expansion (hereinafter referred to as the coefficient of thermal expansion). During the operation of the CRT, the electron gun is heated at a high temperature. In the electron gun constructed in this manner, since the first grid electrode 16 and the cathode support 15 are fixedly welded to each other, the first grid electrode 16 and the cathode support 15 are deformed by the difference between their coefficients of thermal expansion.

In the electron gun structure which constitutes the above-described electron gun, the amounts of thermal expansion assume the relationship of the first grid electrode 16>the cathode support 15. In this case, when the first grid electrode 16 is expanded, the cup-shaped first grid electrode 16 pulls the cathode support 15 in the directions indicated by arrows in FIG. 7. Since the first grid electrode 16 is fixed to the bead glass by the bead portion 19, the cathode support is deformed in the direction in which the central portion of the cathode support 15 approaches the first grid electrode 16 compared to the edge portion of the same. Accordingly, the cathode surfaces of the cathode structures 20 fixed to the cathode support 15 approach the first grid electrode 16. Specifically, the distance between the cathode surface of the center cathode structure 20C and the first grid electrode 16 becomes shorter than the distance between the cathode surface of the side cathode structures 20S and the first grid electrode 16.

FIG. 9 is a graph which shows a variation in cathode current with time, wherein the vertical axis represents cathode current and the horizontal axis represents time.

Reference numeral 23 denotes a variation in the cathode current of the center cathode, and reference numeral 24 denotes a variation in the cathode current of each side cathode.

For example, FIG. 9 shows variations in cathode currents with time in a cathode ray tube of $\phi 29$ neck in which the cathode support 15 is made of 42% Ni—Fe (coefficient of thermal expansion: $46\times10^{-7}/°$ C.) and the first grid electrode 16 is made of 50% NI—Fe (coefficient of thermal expansion: $100\times10^{-7}/°$ C.). As shown in FIG. 9, when about 10 minutes passes after power is turned on, the gap between the cathode surfaces and the first grid electrode becomes stable and the cathode currents become constant. For this reason, the best cathode current value (set value) is set to the value of each of the cathode currents obtained when about 10 minutes passes after power is turned on. As shown in FIG. 9, according to the welding positions in the above-described structure, when about 1 minute passes after power is turned on, the cathode current at the center cathode reaches 115% of the set value and the cathode current at each of the side cathodes reaches 150% of the set value, and the difference in cathode current between the center cathode and each of the side cathodes is about 35%. Normally, in the electron gun of $\phi 29$, the difference in cathode current between the center and side cathodes reaches its maximum in about 1 minute after power is turned on, but in the case of the welding positions in the above-described structure, the difference in cathode current between the center and side cathodes reaches a maximum of 35% until the cathode currents become stable after power is turned on. The related art cathode ray tube has the problem that at the starting time of its operation, the difference between the cathode current of the center cathode and the cathode current of each of the side cathodes is so large that no desired colors can be displayed on the screen. In other words, in the related art cathode ray tube, the manner of variation of the distance between the cathode surface at the center portion and the first grid electrode differs from the manner of variation of the distance between the cathode surface at each side portion and the first grid electrode, so that it is difficult to stably supply electron beams to the phosphor screen.

It has recently been proposed to provide a cathode ray tube in which the sensitivity of its deflection yokes to electron beams is increased to reduce the power consumed for deflecting the electron beams. Such a cathode ray tube has a reduced neck diameter. However, the electron gun of the cathode ray tube has the disadvantage that a cutoff voltage which is determined by the distance between the cathodes and the first grid electrode becomes so sensitive that adjustment of the cutoff voltage becomes difficult.

SUMMARY OF THE INVENTION

The invention provides a color cathode ray tube provided with an electron gun which is capable of making more uniform a variation in the gap between the cathodes and the first grid electrode at the center portion and at each side portion, and making more uniform the amounts of cathode currents of the center cathode and each side cathode during the start-up period of the cathode ray tube, thereby maintaining color balance on the screen. The invention also provides a color cathode ray tube provided with an electron gun which is capable of restraining a variation in the distance between the cathodes and the first grid electrode and reducing a variation in brightness during a long-time operation of the cathode ray tube.

To make more uniform the amount of variation with time in the gap between the cathodes and the first grid electrode at the center portion and at each side portion, it is necessary to make more uniform the thermal deformation of a cathode support in the inline direction thereof.

For this purpose, the invention provides a color cathode ray tube which includes: an evacuated envelope including a panel portion on which a phosphor screen is formed, a neck portion, and a funnel portion which connects the panel portion and the neck portion; and an electron gun having at least an electron beam generating unit which generates three electron beams toward the phosphor screen in a horizontal plane, the electron beam generating unit being housed in the neck portion and being made of cathodes, a first grid electrode and an accelerating electrode, the electron gun further including a plurality of electrodes fixedly buried in an insulating material in a predetermined array and at predetermined intervals in a tube axis direction. The first grid electrode has a cup-like shape, and each cathode structure is fixed to a cathode support in an electrically insulated state by glass. Each of the cathode support and the first grid electrode has a rectangular or elliptical face, and the first grid electrode houses the cathode support, and a fixing portion for fixing the first grid electrode and the cathode support to each other is located in a shorter-side portion.

Otherwise, the fixing portion for fixing the first grid electrode and the cathode support to each other is welded on an axis along which the cathode structures are arrayed (hereinafter referred to as the inline axis).

According to the above-described construction, the amount of variation in the distance between the cathode surface of the center portion and the first grid electrode can be made approximately equal to the amount of variation in the distance between the cathode surface of each side portion and the first grid electrode. In addition, when the cathodes are heated by heaters and electron beams are radiated from electron radiating substances lying over the electron emitting surfaces of the cathodes, it is possible to restrain thermal deformation of the cathode support in the inline direction, thereof, whereby it is possible to maintain the concentration of electron beams on the screen.

BRIEF DESCRIPTION OF THE DRAWINGS

The invention will become more readily appreciated and understood from the following detailed description of a preferred embodiment of the invention when taken in conjunction with the accompanying drawings, in which.

DETAILED DESCRIPTION OF THE INVENTION

An embodiment of the invention will be described in detail with reference to the accompanying drawings.

Figure 1:
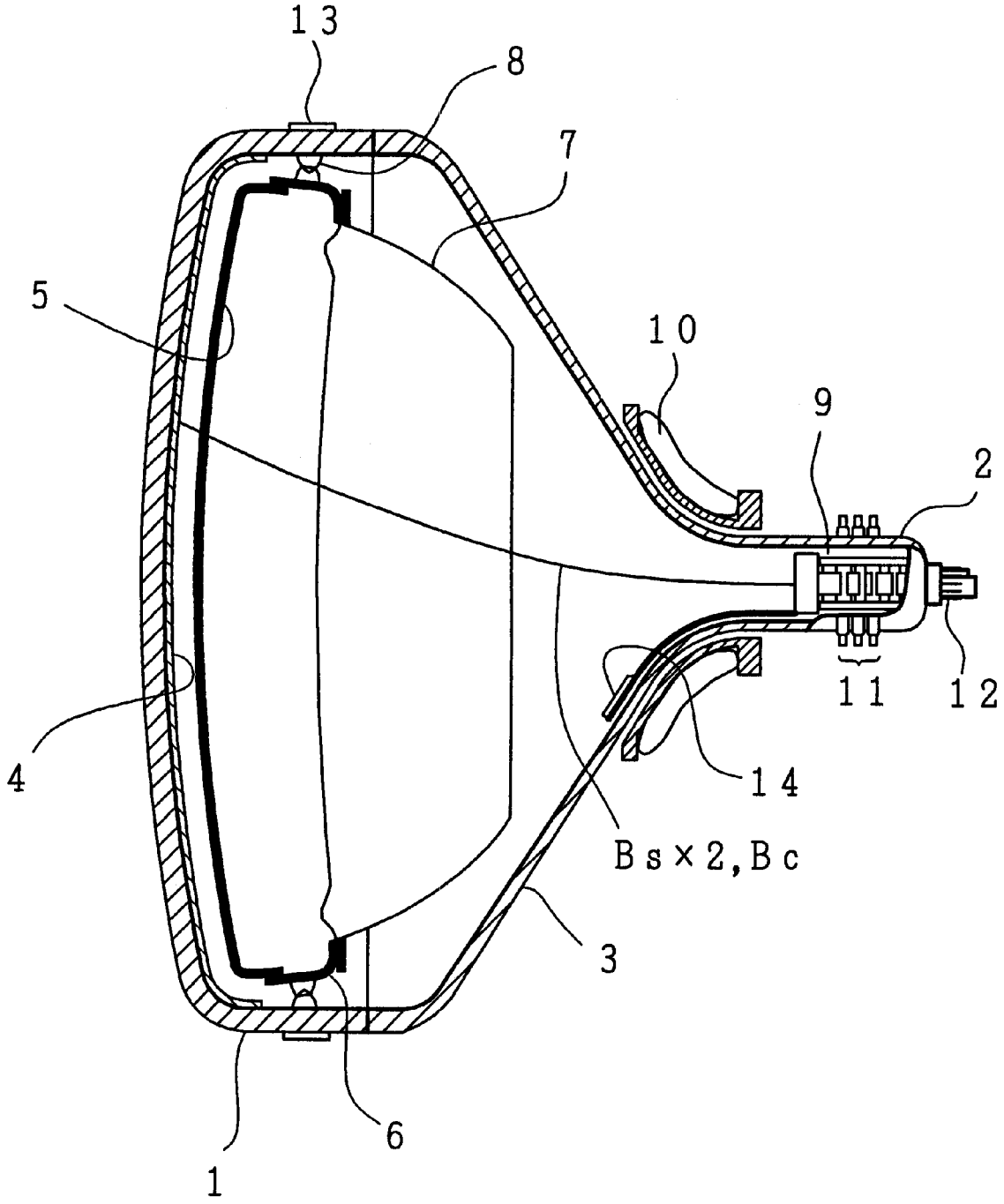
FIG. 1 is a cross-sectional view of a cathode ray tube to which the invention is applied.

FIG. 1 is a schematic cross-sectional view illustrating the construction of a shadow mask type color cathode ray tube, which is one example of a color cathode ray tube to which the present invention is applied. The cathode ray tube comprises a faceplate 1, a neck 2, a funnel 3 for connecting the faceplate 1 and the neck 2, a phosphor screen 4 which is formed on the inner surface of the faceplate 1 and constitutes an image display screen, a shadow mask 5 which operates as a color selecting electrode, a mask frame 6 which holds the shadow mask 5 and constitutes a shadow mask assembly, an inner shield 7 which shields the cathode ray tube from external magnetism, stud pins 8 for supporting the shadow mask assembly on the inside wall of the faceplate 1, an electron gun 9 structure which is housed in the neck 2 and emits three electron beams Bs×2 and Bc, a deflection device 10 which deflects the electron beams horizontally and vertically, an external correction magnetic unit 11 for correcting color purity and centering, stem pins 12 which supply various signals and an operating voltage to the electron gun, an anti-implosion tension band 13 which retains the area of connection between a panel and the funnel 3, and a getter 14 for increasing the degree of vacuum in the evacuated envelope.

In the construction shown in FIG. 1, the three electron beams Bs×2 and Bc emitted from the electron gun 9 are deflected horizontally and vertically by a deflecting magnetic field formed by the deflection device 10, and the three beams are screened by the shadow mask 5 and are two-dimensionally scanned on the phosphor screen 4, thereby displaying an image. Incidentally, symbol Bc denotes a center beam and symbol Bs denote a side beam.

Figure 2:
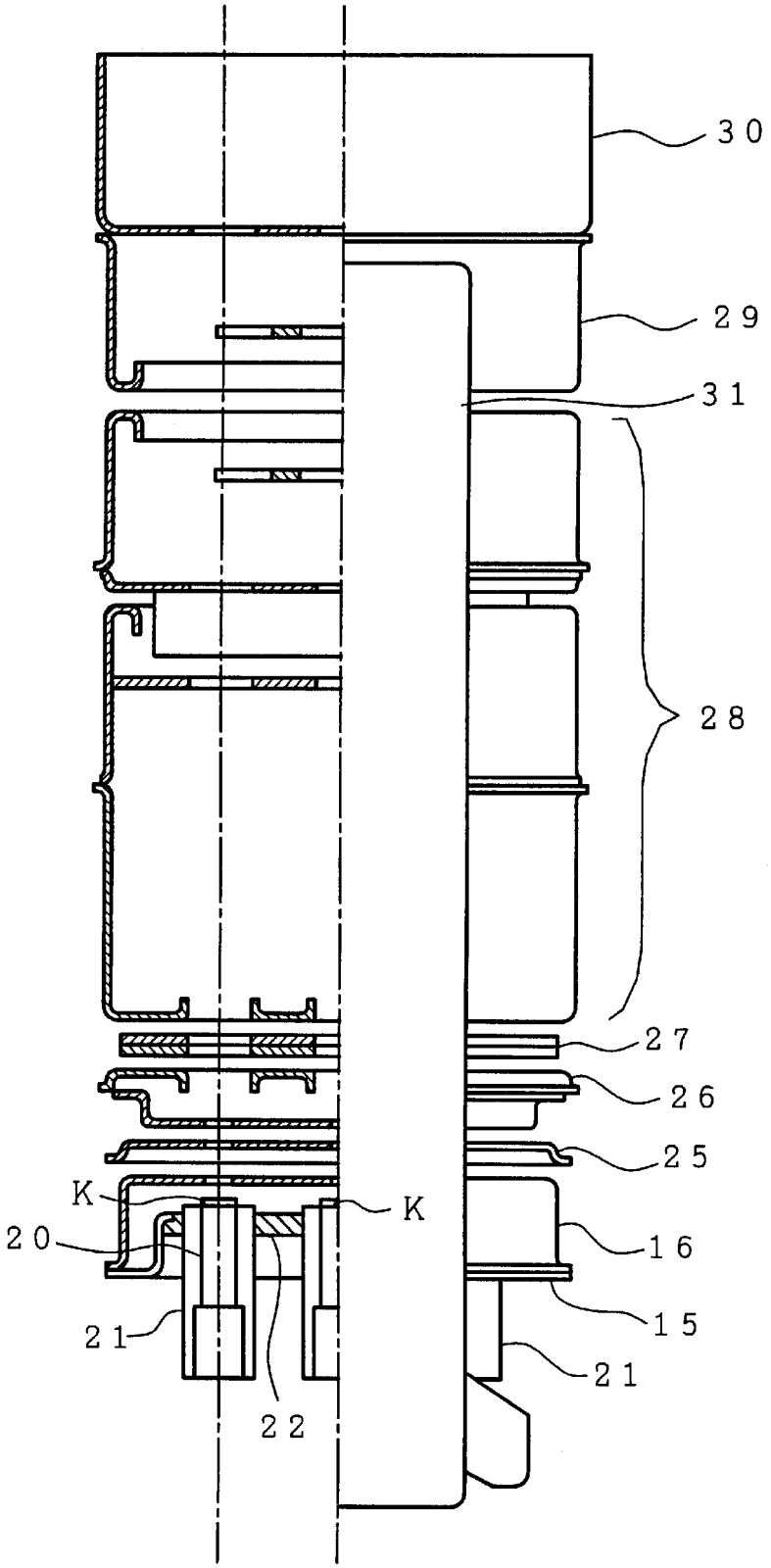
FIG. 2 is a partial cross-sectional view of an electron gun according to the invention.

FIG. 2 shows one example of an inline electron gun structure to which the present invention is applied, and the left-hand and right-hand portions of FIG. 2 show a cross-sectional view and a side view, respectively. The electron gun comprises cathodes K, a cathode support 15 provided with a cathode inside, a cup-shaped first grid electrode 16, cathode structures 20 each provided with a cathode K for emitting an electron beam toward a surface opposed to the first grid electrode 16, sleeves 21 to which the respective cathode structures 20 are fixed, a hermetic glass (insulating substrate) 22, a second grid electrode 25, a third grid electrode 26, a fourth grid electrode 27, a fifth grid electrode 28, a sixth grid electrode 29, a shield cup 30, and a bead glass 31 which fixes each of the electrodes in an electrically insulated state. A triode portion is formed by the cathodes K, the first grid electrode 16 and the second grid electrode 25.

The shield cup 30 is fixed to the sixth grid electrode 29 of an anode. The first grid electrode 16, the second grid electrode 25, the third grid electrode 26, the fourth grid electrode 27, the fifth grid electrode 28 and the sixth grid electrode 29 are arrayed at predetermined intervals in the direction of the tube axis of the cathode ray tube, and are fixedly supported by the bead glass 31.

The center cathode is arranged to approximately coincide with the tube axis of the cathode ray tube, while the side cathodes are arranged along an axis approximately perpendicular to the tube axis and in opposition to the phosphor screen.

Figure 3:
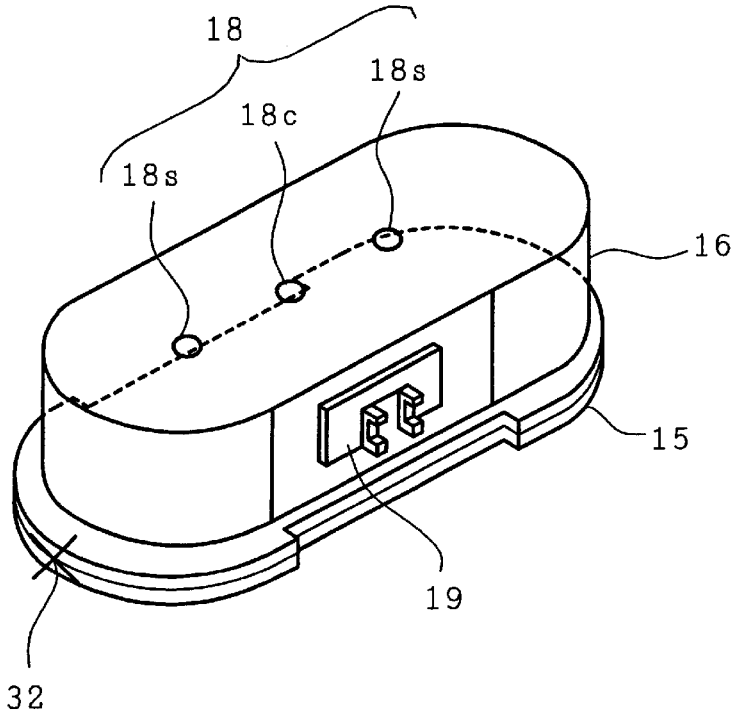
FIG. 3 is a perspective view of an embodiment of the invention in which a cathode support 15 and a first grid electrode 16 are fixed.

FIG. 3 is a side view of an embodiment of the present invention in which the cathode support 15 and the first grid electrode 16 are fixed. The cathode support 15 is fixed to the bead glass 31 via the first grid electrode 16.

The cathode support 15 is inserted in the cup-shaped first grid electrode 16, and is welded at a welding spot 32 located in a flange portion of its open end. Another welding spot 32 is present in an opposite portion which is not shown in FIG. 3, so that the first grid electrode 16 and the cathode support 15 are fixed to each other at two spots.

During the start-up period of the cathode ray tube, each of the cathodes K is heated by a heater which is not shown, and an electron beam is radiated from an electron radiating substance lying over the electron emitting surface of each of the cathodes K and a cathode current flows.

A variation in the cathode current is chiefly determined by a variation in the gap between each of the cathodes K and the first grid electrode 16. This cathode current is determined by the gap size between the first grid electrode 16 and the electron emitting surface (cathode surface) of each of the cathodes K, and as the gap size becomes narrower, the cathode current becomes larger and the brightness on the screen becomes higher.

The cathode structures 20 heated by the respective heaters expand toward the first grid electrode 16 by thermal expansion, and the gap between the cathodes K and the first grid electrode 16 becomes narrow. After that, the cathode support 15 and the control grid electrode are thermally deformed, and become stable in that state. Since the first grid electrode 16 and the cathode support 15 are welded to each other at locations on the inline axis so that the center cathode structure and the side cathode structures become equal in thermal deformation during this time, the thermal deformation of the cathode support 15 in the inline direction can be made uniform, whereby the color balance on the screen can be maintained.

In accordance with the invention, since the first grid electrode 16 and the cathode support 15 are fixed on the inline axis, the force of thermal expansion of the first grid electrode 16 which pulls the cathode support 15 can be allowed to work in only the inline direction, whereby it is possible to reduce the forces which work in directions perpendicular to the inline direction and the tube-axis direction. In other words, it is possible to reduce the positional deviation of the cathode surfaces from the electron beam passing holes 18 of the first grid electrode 16.

In addition, in accordance with the invention, since the spots where the first grid electrode 16 and the cathode support 15 are fixed to each other are located in the inline direction, the expansion of the cathode support 15 in the inline direction needs only to be taken into account, and even if the distance between the cathode surfaces and the first grid electrode 16 varies, the amount of variation in the distance between the cathode surface of the center cathode structure 20C and the first grid electrode 16 can be made approximately equal to the amount of variation in the distance between the cathode surfaces of the side cathode structures 20S and the first grid electrode 16.

Figure 4:
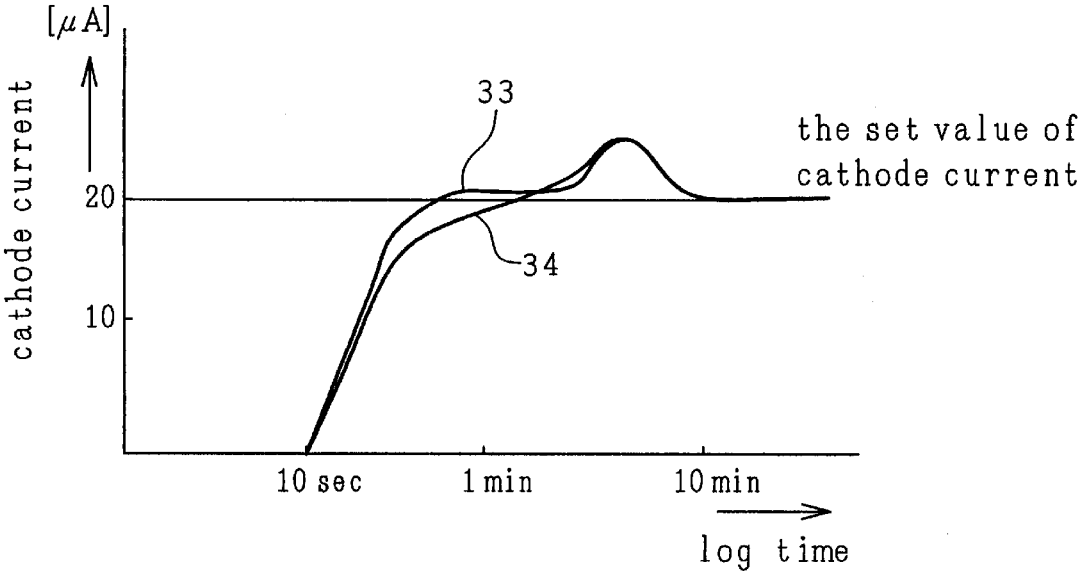
FIG. 4 is a graph showing variations in cathode currents with time in a cathode ray tube according to the invention.

FIG. 4 is a graph which shows variations in cathode currents With time in a cathode ray tube according to the invention. The vertical and horizontal axes represent cathode current and time, respectively, and reference numeral 33 denotes a variation in the cathode current of the center cathode, while reference numeral 34 denotes a variation in the cathode current of each of the side cathodes. FIG. 4 also shows variations in cathode currents with time in an electron gun of $\phi 29$ in which the cathode support 15 is made of 42% Ni—Fe (coefficient of thermal expansion: $46\times10^{-7}$/° C.) and the first grid electrode 16 is made of 50% Ni—Fe (coefficient of thermal expansion: $100\times10^{-7}$/° C.). As shown in FIG. 4, according to the welding positions of the invention, at the time that about 1 minute passes after power is turned on, the cathode current at the center cathode reaches 19.5 mA and the cathode current at each of the side cathodes reaches 21 mA, and when about 10 minutes passes after power is turned on, the cathode currents at the center and side cathodes become stable.

Normally, in an electron gun of $\phi 29$ neck, the difference in cathode current between the center and side cathodes reaches its maximum in about 1 minute after power is turned on, but the invention makes, it possible to reduce the difference in cathode current between the center and side cathodes to a maximum of 10% or less until the cathode currents become stable after power is turned on.

At the starting time of the operation of the cathode ray tube, the difference between the cathode current of the center cathode and the cathode current of each of the side cathodes is kept within 10%, whereby even at the starting time of the operation, the cathode ray tube can display desired colors on the screen and provide a good image. Specifically, it is possible to make the amount of variation in the gap between the cathodes K and the first grid electrode 16 approximately equal between the center portion and each side portion.

In addition, as shown in FIG. 4, in case the first grid electrode 16 and the cathode support 15 to which the cathodes K are fixed are disposed so that the cathode currents become stable at 20 $\mu$A, the cathode currents can be stabilized without greatly exceeding the set value. In other words, since the amount of variation in the distance between the cathode surfaces and the first grid electrode is small, after power is turned on, electron beams can be stably supplied to the phosphor screen without allowing the cathode currents to flow to an excessive extent.

Figure 5:
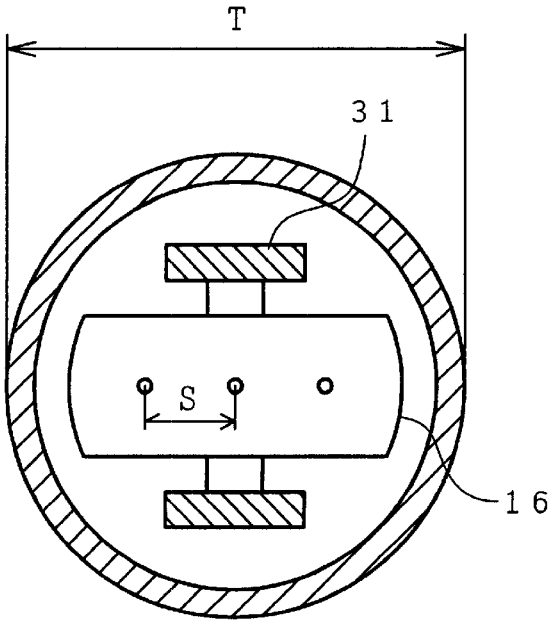
FIG. 5 is a cross-sectional view of a neck portion.

FIG. 5 is a cross-sectional view of a neck portion which is cut on a plane perpendicular to the tube axis of the cathode ray tube, and also is a cross-sectional view of the first grid electrode 16 as viewed from its phosphor-screen side. Letting T (mm) and S (mm) be the outer diameter of the neck portion and the distance between the center axes of adjacent electron beams, respectively, T and S are $2S+14,6 \leqq T \leqq 28.1$, and $4.1 \leqq S$. In this cathode ray tube, the sensitivity of deflection yokes to electron beams is increased to reduce the power consumption of the deflection yokes for deflecting electron beams. For this reason, the neck diameter is reduced as disclosed in, for example, Japanese Patent Laid-Open No. 141999/1995.

In a cathode ray tube provided with an electron gun of small neck diameter, it is difficult to increase the diameter of a main lens through which electron beams pass, because of the small neck diameter. For this reason, the diameter of the main lens is limited, and it is difficult to improve the focus characteristic by using the main lens. To overcome this difficulty, the diameters of the electron beam passing holes of the first grid electrode are decreased to reduce the diameter of an object point, thereby reducing an image point.

However, as the hole diameters of the first grid electrode are made smaller, the cutoff voltage for taking electrons out of the cathodes becomes more sensitive, so that adjustment of the cutoff voltage becomes more difficult. This cutoff voltage is determined by the distance between the cathodes and the first grid electrode.

In the electron gun used in this cathode ray tube, the cathode support 15 to which the cup-shaped first grid electrode 16 and the cathode structures 20 are fixed by glass is fixed, and the first grid electrode 16 and the cathode support 15 are welded to each other on an axis along which the cathode structures 20 are arrayed.

Figure 6:
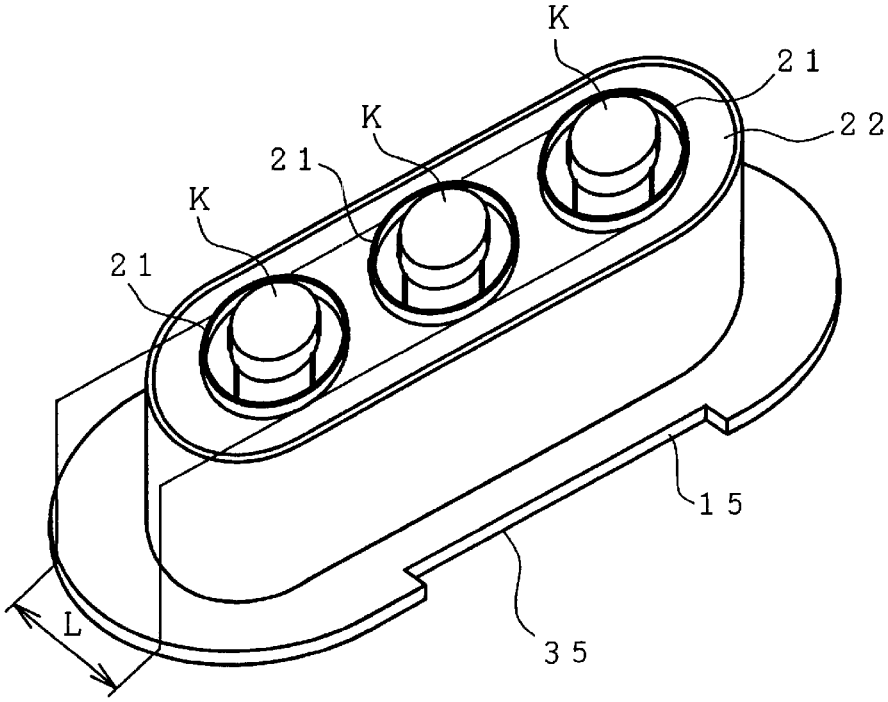
FIG. 6 is a perspective view of a cathode support to be contained in the first grid electrode.
Figure 7:
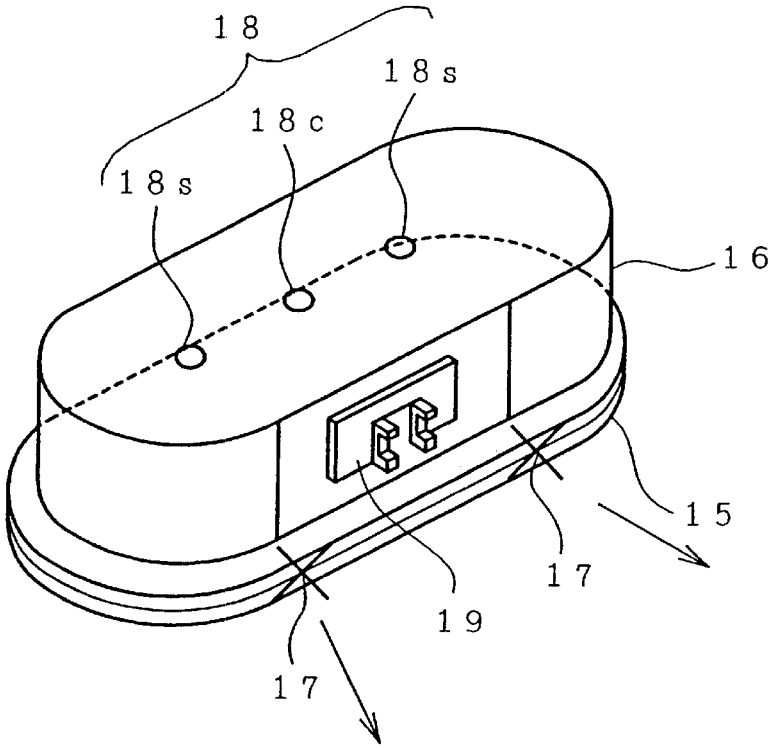
FIG. 7 (PRIOR ART)
FIG. 7 is a perspective view showing a typical cathode support to which the first grid electrode is fixed.
Figure 8:
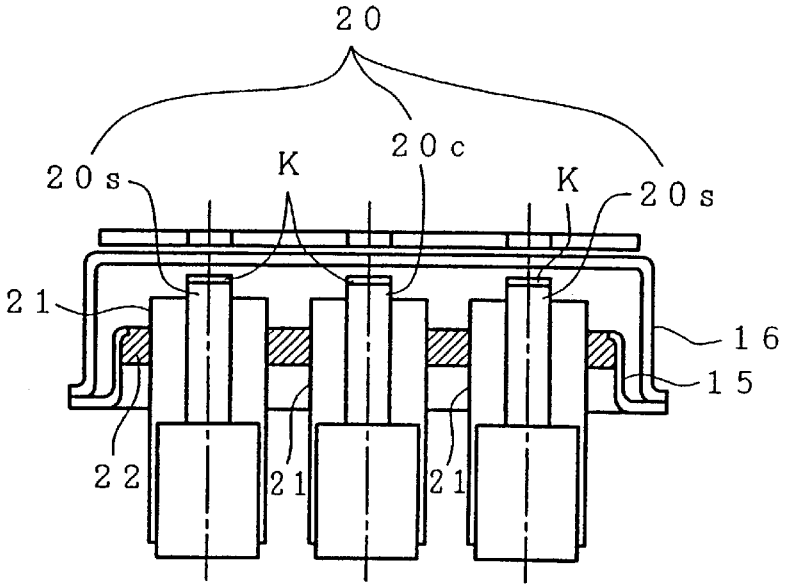
FIG. 8 (PRIOR ART)
FIG. 8 is a cross-sectional view of a triode portion of an electrode gun taken in the inline direction thereof.
Figure 9:
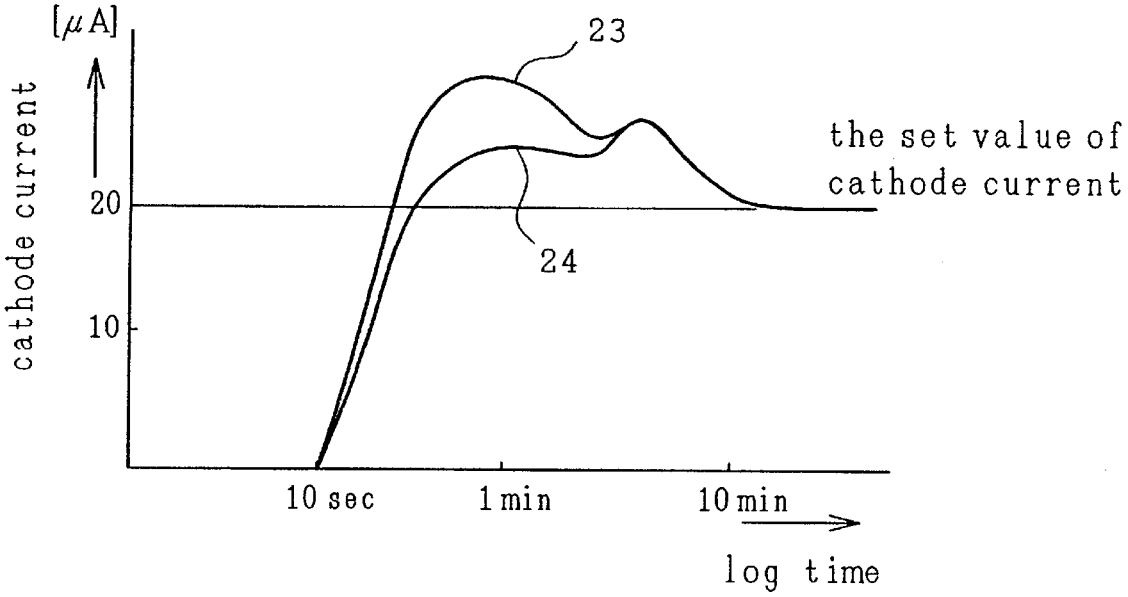
FIG. 9 (PRIOR ART)
FIG. 9 shows variations in cathode currents with time in a typical cathode ray tube.

FIG. 6 is a perspective view of the cathode support 15 contained in the first grid electrode 16, showing the range of positions at which the cathode support 15 can be fixedly welded to the first grid electrode 16. In FIG. 6, portions identical to those shown in FIG. 2 are denoted by reference numerals identical to those used in FIG. 2.

The spots of welding of the first grid electrode and the cathode support need not necessarily be located on the inline axis. In case the first grid electrode and the cathode support have approximately rectangular surfaces, the first grid electrode and the cathode support may be welded at sides which intersect the inline axis.

Referring to FIG. 6, the cathode support 15 has an elliptical shape, and forces which act in directions perpendicular to the inline axis and the tube axis can be reduced by locating the welding spots of the first grid electrode 16 and the cathode support 15 on the shorter sides thereof which have a radius of curvature.

In addition, the welding spots of the first grid electrode 16 and the cathode support 15 need only be located in directions perpendicular to the inline axis and the tube axis within an area of a width equal to a width L of each of the sleeves 21 to which the respective cathode structures 20 are fixed. Within the area of width L, a plurality of welding spots may also be provided. Preferably, such welding spots may be located within an area of width equal to the width of each of the cathodes taken in the direction perpendicular to the inline direction.

By locating the welding spots of the first grid electrode 16 and the cathode support 15 at the sides which intersect the inline axis, it is possible to reduce forces which work in directions perpendicular to the inline direction and the tube-axis direction, whereby it is possible to reduce the distortion of the structure formed by fixedly welding the cathode support 15 and the first grid electrode 16 to each other.

A cutout portion 35 is provided in the cathode support 15 on a longer side thereof the sleeves 21 and the cathode support 15 are fixed together in a high-temperature state by the hermetic glass 22. Therefore, when the sleeves 21, the hermetic glass 22 and the cathode support 15 become cold, all of them shrink by thermal expansion. At this time, since the coefficient of thermal expansion of the cathode support 15 is larger than the coefficient of thermal expansion of the hermetic glass 22, the amount of shrinkage of the lower portion of the cathode support 15 having no hermetic glass is larger than the amount of shrinkage of the upper portion of the cathode support 15 having the hermetic glass 22. By providing the cutout portion 35 in the longer-side flange of the cathode support 15, it is possible to reduce the amount of shrinkage due to thermal expansion, whereby it is possible to prevent the deformation of the cathode support 15.

In this construction, it is possible to make more uniform the variations in the gap between the cathodes K and the first grid electrode 16 between the center portion and each of the side portions; and, particularly in a cathode ray tube using an electron gun in which the gap between the cathodes K and the first grid electrode 16 needs to be controlled with high accuracy, the amounts of cathode currents of the center cathode and each side cathode can be made coincident. Accordingly, it is possible to provide a color cathode ray tube capable of maintaining color balance on the screen. In addition, it is possible to provide a color cathode ray tube provided with an electron gun capable of restraining a variation in the distance between the cathodes and the first grid electrode and reducing a variation in brightness during the long-time operation of the cathode ray tube.

In addition, since the cathodes are fixed to the inside of the cup-shaped first grid electrode, it is possible to provide a color cathode ray tube provided with an electron gun capable of restraining a variation in the distance between the cathodes and the first grid electrode and reducing a variation in brightness during long-time operation of the cathode ray tube.

With the construction according to the invention, it is possible to restrain the deformation of the first grid electrode or the cathodes due to thermal expansion and it is also possible to reduce a variation in the gap between the cathodes and the first grid electrode, whereby it is possible to stably supply cathode currents. Moreover, it is possible to make more uniform the amount of variation with time in the gap between the cathodes and the first grid electrode at the center portion, as well as at each side portion.

The cathode ray tube according to the invention is capable of stably maintaining color balance on the screen by making more uniform the amounts of cathode currents of the center cathode and each side cathode during the start-up period of the cathode ray tube, and the invention is particularly suited to a color cathode ray tube provided with a plurality of cathodes.

What is claimed is:

1. A color cathode ray tube comprising:

an evacuated envelope including a panel portion on which a phosphor screen is formed, a neck portion, and a funnel portion which connects the panel portion and the neck portion; and an electron gun having an electron beam generating unit which emits three electron beams toward the phosphor screen in a horizontal plane, the electron beam generating unit being housed in the neck portion and having plural cathodes, a first grid electrode and an accelerating electrode, the electron gun further including a plurality of electrodes fixedly buried in an insulating material in a predetermined array and at predetermined intervals in a tube-axis direction, the first grid electrode having a cup-like shape and having a bead portion to be buried in the insulating material, each cathode being fixed to a cathode support in an electrically insulated state by glass, each of the cathode support and the first grid electrode having a rectangular or elliptical face, the first grid electrode housing the cathode support in its inside, a fixing portion for fixing the first grid electrode and the cathode support to each other being located in a shorter-side portion.

2. A color cathode ray tube according to claim 1, wherein each cathode is supported by a sleeve, and the fixing portion for fixing the first grid electrode and the cathode support to each other is located in an area which does not exceed the width of a sleeve.

3. A color cathode ray tube according to claim 1, wherein the fixing portion for fixing the first grid electrode and the cathode support to each other is welded on an axis along which the cathode structures are arrayed.

4. A color cathode ray tube according to claim 1, wherein the cathode support has a flange portion, a cutout being formed in the flange portion on a longer side thereof.

5. A color cathode ray tube according to claim 1, wherein an outer diameter T of the neck portion is $2S+14.6 \leqq T \leqq 28.1$, and an electron beam spacing S of the electron gun is $4.1 \leqq S$.

* * * * *